US005485864A

United States Patent [19]

Takeuchi et al.

[11] Patent Number: 5,485,864

[45] Date of Patent: Jan. 23, 1996

[54] PRESSURE COMPENSATION VALVE

[75] Inventors: Masamitsu Takeuchi; Kazuyoshi Ishihama; Kazunori Ikei, all of Kanagawa, Japan

[73] Assignee: Kabushiki Kaisha Komatsu Siesakusho, Tokyo, Japan

[21] Appl. No.: 347,437

[22] PCT Filed: May 28, 1993

[86] PCT No.: PCT/JP93/00724

§ 371 Date: Nov. 23, 1994

§ 102(e) Date: Nov. 23, 1994

[87] PCT Pub. No.: WO93/24756

PCT Pub. Date: Sep. 12, 1993

[30] Foreign Application Priority Data

May 28, 1992 [JP] Japan ..... 4-42200 U

[51] Int. Cl.[6] ..... F15B 11/05; F15B 11/16

[52] U.S. Cl. ..... 137/118; 137/116

[58] Field of Search ..... 137/118, 115, 137/116, 109

[56] References Cited

U.S. PATENT DOCUMENTS 3,246,845 4/1966 Techler ..... 137/116 X
3,834,162 9/1974 Keady ..... 137/118 X
4,173,866 11/1979 Farr ..... 137/115 X
4,378,816 4/1983 Peiffer ..... 137/118 X

FOREIGN PATENT DOCUMENTS 503962 6/1951 Belgium ..... 137/118
60-11706 1/1985 Japan .

*Primary Examiner*—Stephen M. Hepperle
*Attorney, Agent, or Firm*—Wenderoth, Lind & Ponack

[57] ABSTRACT

A pressure compensation valve is capable of distributing of an output pressurized fluid of single pressurized fluid supply source to a plurality of hydraulic loads. The pressure compensation valve is constructed with a check valve portion formed by providing, in a valve body, a valve for establishing and blocking communication between an inlet port and an outlet port, and a pressure reduction valve formed by providing, in the valve body, a spool establishing communication between a second port and a third port by a pressure in a first pressure chamber communicating with a first port and blocking communication between the second port and the third port by a pressure in a second pressure chamber communicating with the third port. The spool is biased in a direction for blocking communication between the second port and the third port by a spring while contacting the valve.

9 Claims, 10 Drawing Sheets

PRESSURE COMPENSATION VALVE

BACKGROUND OF THE INVENTION

1. Field of the Invention

The present invention relates to a pressure compensation valve to be employed in a hydraulic circuit and so forth for distributing pressurized working fluid supplied from a signal pressurized fluid source to a plurality of hydraulic loads at respectively predetermined flow rates. More specifically, the invention relates to a pressure compensation valve which can distribute the pressurized working fluid of the common pressurized fluid source to a plurality of hydraulic loads, such as hydraulic actuators, without employing a shuttle valve.

2. Description of the Related Art

When a pressurized fluid discharged from a single hydraulic pump is distributed to a plurality of actuators, pressurized fluid tends to be supplied only to the actuator having the lowest load pressure. For avoiding this, hydraulic circuits, such as that shown in Japanese Unexamined Patent Publication (Kokai) No. Showa 60-11706, for example, have been known. Namely, the hydraulic circuit is constructed such that pressure compensation valves are provided at the inlet sides of direction control valves connected to respective actuators, which pressure compensation valves are set at the highest load pressure among load pressures of respective actuators for distributing flow rates of pressurized fluid discharged from a hydraulic pump to a plurality of actuators having respectively different load pressures.

The pressure compensation valve to be employed in such a hydraulic circuit has a construction for determining an output pressure on the basis of a pressure difference between a higher pressure side pressure chamber and a lower pressure side pressure chamber or a pressure difference between an inlet pressure and an outlet pressure. Therefore, highest load pressure must be introduced to the low pressure side pressure chamber and thus requires a shuttle valve which compares load pressures of respective actuators.

SUMMARY OF THE INVENTION

It is an object of the present invention to provide a pressure compensation valve which can simplify the conventional construction and enables distribution of hydraulic output pressure of a single hydraulic pressure supply source to a plurality of hydraulic loads without employing the shuttle valve.

In order to accomplish the above-mentioned objects, according to the first aspect of the invention, a pressure compensation valve comprises:

a check valve portion formed by providing, in a valve body, a valve for establishing and blocking communication between an inlet port and an outlet port, and a pressure reduction valve formed by providing, in the valve body, a spool establishing communication between a second port and a third port by a pressure in a first pressure chamber communicating with the first port and blocking communication between the second port and the third port by a pressure in a second pressure chamber communicating with the third port, the spool being biased in a direction for blocking communication between the second port and the third port by a spring and while contacting the valve.

According to the second aspect of the invention, a pressure compensation valve comprises:

a check valve portion formed by providing, in a valve body, a valve for establishing and blocking communication between an inlet port and an outlet port, and a pressure reduction valve formed by providing, in the valve body, a spool establishing communication between a second port and a third port via a radially extending conduit and a blind hole by a pressure in a first pressure chamber communicating with a first port and blocking communication between the second port and the third port by a pressure in a second pressure chamber communicating with the third port, the spool being biased in a direction for blocking communication between the second port and the third port by a spring while contacting the valve.

According to the third aspect of the invention, in a pressurized fluid supply system connecting a plurality of pressure compensation valves to a pump discharge passage of a hydraulic pump, providing direction control valves at the outlet sides of respective pressure compensation valves, and supplying discharged pressurized fluid of the hydraulic pump to a plurality of actuators, the pressure compensation valves each comprise:

a check valve portion for establishing and blocking communication between the pump discharge passage and an inlet port of a direction control valve, and a pressure reducing portion for reducing the pump discharge pressure, the check valve portion being formed by providing, in a valve body, a valve for establishing and blocking communication between an inlet port and an outlet port, and the pressure reducing portion being a pressure reduction valve formed by providing, in the valve body, a spool establishing communication between a second port and a third port by a pressure in a first pressure chamber communicating with a first port and blocking communication between the second port and the third port by a pressure of a second pressure chamber communicating with the third port, the spool being biased in a direction for blocking communication between the second port and the third port by a spring while contacting the valve in a pressurized fluid supply system.

According to the fourth aspect of the invention, a pressure compensation valve comprises:

a check valve portion provided in a valve body and having a valve for establishing and blocking communication between an inlet port and an outlet port;

a pressure reducing valve portion provided in the valve body, connected to a hydraulic load and having a spool biased in a direction for establishing communication between a second port connected to a supply passage for supplying the output hydraulic pressure of a hydraulic pressure source and a third port introducing a pressure corresponding to a maximum load pressure by a pressure of a first pressure chamber communicating with a first port, to which a load pressure of the hydraulic load is introduced, and biased in a direction for blocking communication between the second port and the third port by a pressure in a second pressure chamber communicating with the third port, and a spring exerting a bias force on the spool to bias the spool in a direction for blocking communication between the second port and the third port.

In the construction set forth above, it is possible that a blind bore is formed in the spool, a piston is inserted within the blind bore for biasing the spool in the direction for blocking communication between the second port and the third port by the spring and the piston, and passage for placing the second pressure chamber in communication with the blind bore is provided through the spool. Also, the passage may extend radially through the spool. Furthermore, an orifice may be formed in the spool for establishing communication between the second and third ports.

Further, the second and third ports are formed on the inner periphery of pressure reducing valve receptacle bore, and an annular groove is formed on the outer periphery of the spool for establishing or blocking communication between the second and third ports depending upon a displacement of the annular groove under the shifting of the spool. Also, it is possible that the second and third ports are formed on the inner periphery of pressure reducing valve receptacle bore, a blind hole constantly communicating with the second pressure chamber is formed in the spool, and passage communicating with the blind hole and extending radially through the spool is arranged in the spool at a position that will communicate with the second port at a position of the spool to establish communication between the second and third ports.

BRIEF DESCRIPTION OF THE DRAWINGS

The present invention will be understood more fully from the detailed description given hereinbelow and from the accompanying drawings of the present invention, which, however, should not be taken to be limitative of the present invention, but are for explanation and understanding only.

In the drawings.

BEST MODE FOR CARRYING OUT THE INVENTION

Figure 1:
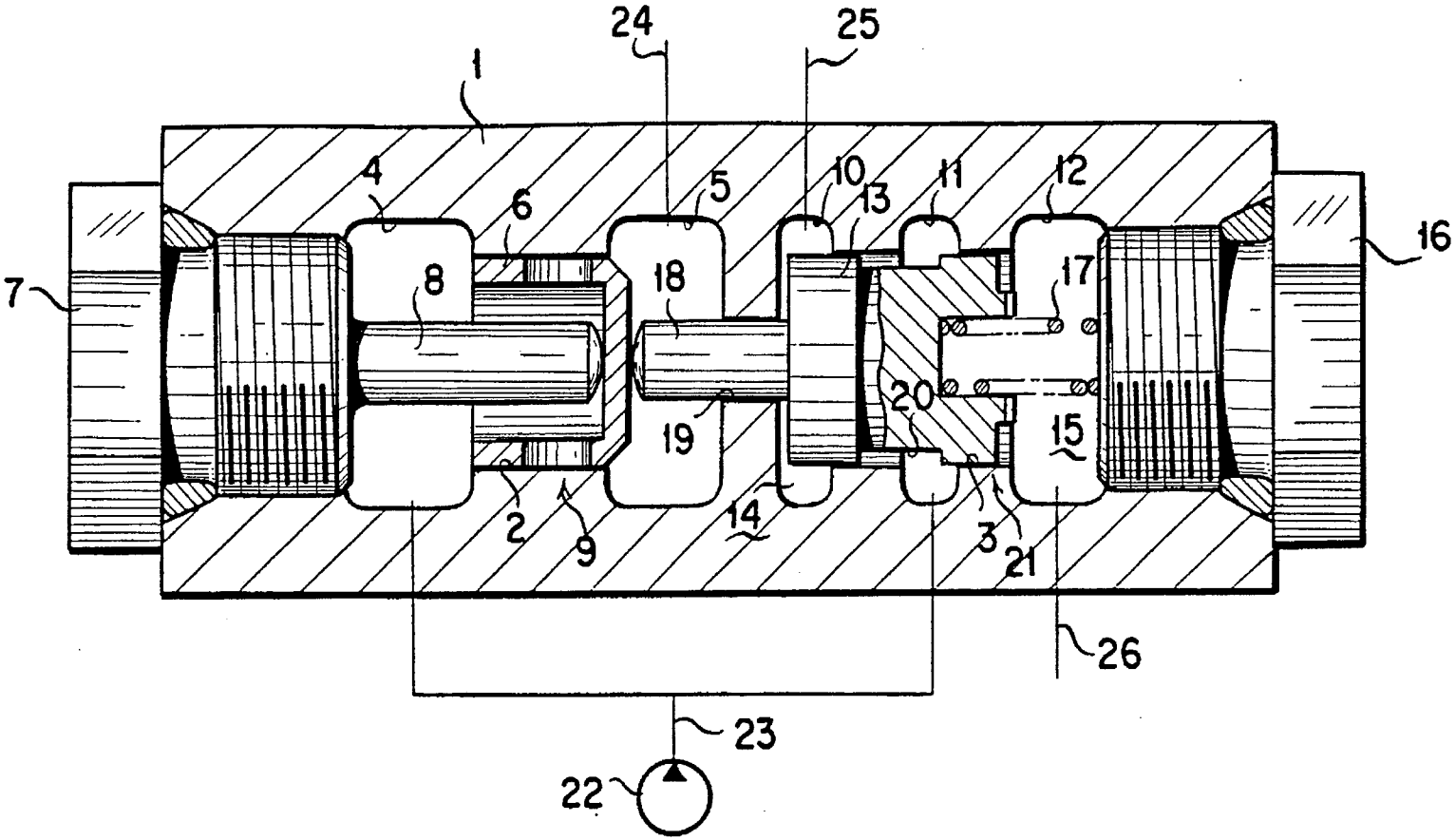
FIG. 1 is a sectional view of a first embodiment of a pressure compensation valve.

As shown in FIG. 1, a check valve receptacle bore 2 and a pressure reduction valve receptacle bore 3 are provided in a valve body 1 in a mutually opposing and aligned fashion. In the check valve receptacle bore 2, an inlet port 4 and an outlet port 5 are formed. In a communication passage between the inlet port 4 and the outlet port 5, a check valve 6 is inserted. The check valve 6 is restricted so as not to slide toward the left from the shown position by a stopper lever 8 and forms a check valve portion 9.

In the pressure reduction valve receptacle bore 3, first, second and third ports 10, 11 and 12 are formed. In a communication passage of the first, second and third ports 10, 11 and 12, a valve spool 13 to delimit a first pressure chamber 14 open to the first port 10 and a second pressure chamber 15 open to the third port 12. Between the valve spool 13 and a plug 16 fitted to the valve body 1 within the pressure reduction valve receptacle bore 3, a spring 17 is inserted. The spring 17 serves to exert a spring force on the valve spool 13 for displacing the valve spool 13 toward the left. The spring force is small. On the valve spool 13, a push rod 18 is formed integrally. The push rod 18 contacts the check valve 6 and blocks respective ports. On the other hand, the valve spool 13 is biased toward the right by a pressure in the first pressure chamber 14. When the first pressure of the first pressure chamber overcomes a second pressure of the second pressure chamber 15, the valve spool 13 is shifted toward the right to establish communication between the second port 11 and the third port 12 via a cut-out 20. By the foregoing construction, a pressure reduction valve portion 21 is formed.

The input port 4 and the second port 11 are connected to a pump discharge passage 23 of a hydraulic pump 22 which supplies pump discharge pressure. The outlet port 5 is connected to a supply passage 24. The first port 10 is connected to a load pressure introduction passage 25 to be supplied with a first control pressure. The third port 12 is also connected to the load pressure detection passage 26 to be supplied with a second control pressure.

Next, the operation will be discussed.

When the pump discharge pressure of the hydraulic pump 22 is low pressure and the pressures of the load pressure introduction passage 25 and the load pressure detection passage 26 are zero, the check valve 6 and the valve spool 13 are placed at the position shown in FIG. 1 to slide the check valve 6 by the pressure of the supply passage 24 to block communication between the outlet port 5 and the inlet port 4 to prevent reverse flow.

Figure 2:
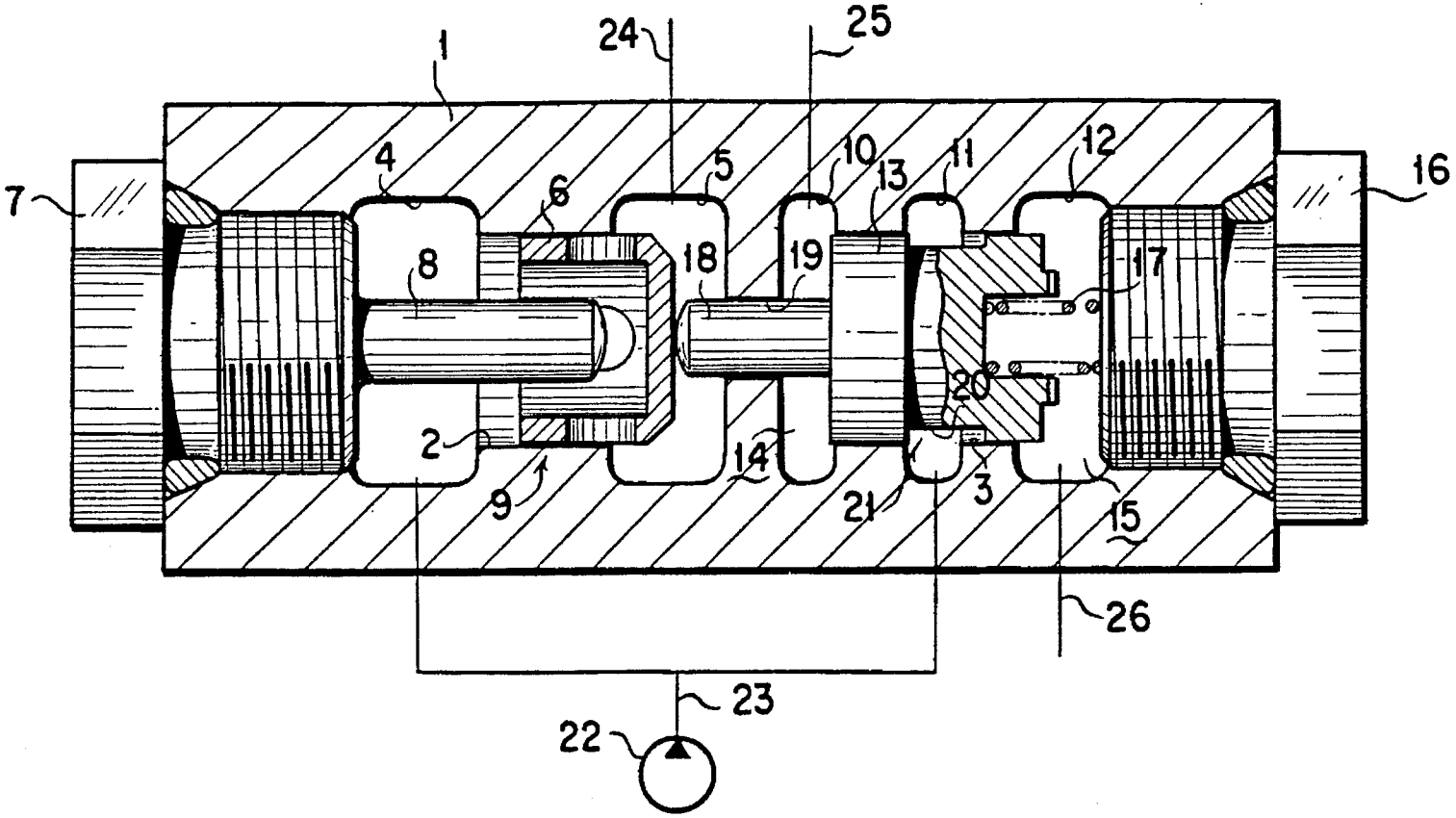
FIG. 2 is an explanatory illustration showing the operation of the first embodiment.
Figure 3:
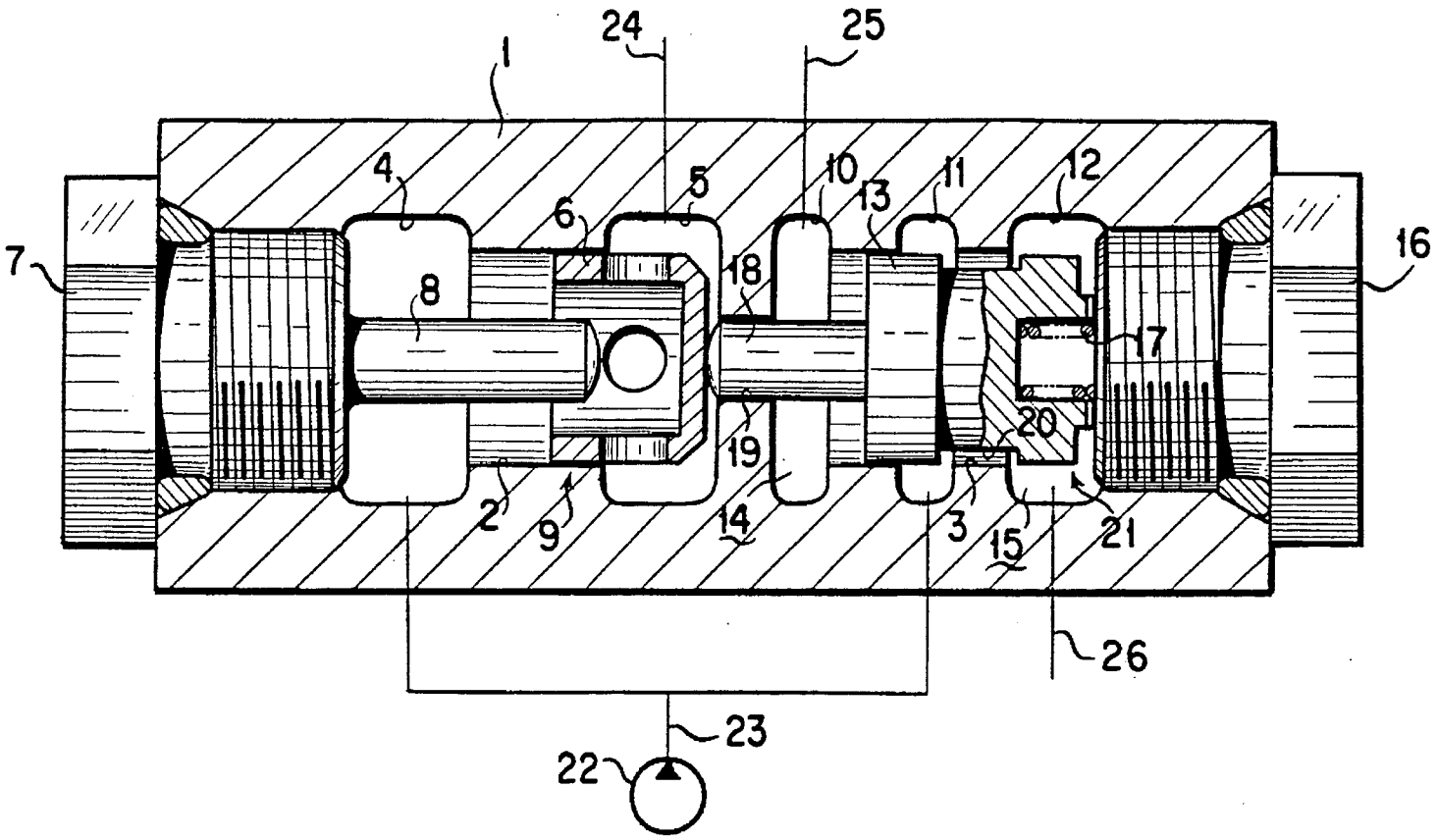
FIG. 3 is an explanatory illustration showing the operation of the first embodiment.

When the pump discharge pressure of the hydraulic pump 22 is has risen, the check valve 6 is urged as shown in FIG. 2 to establish communication between the inlet port 4 and the outlet port 5 to supply the pressurized fluid to the supply passage 24 from the outlet port 5. When the check valve 6 is shifted to the stroke end as shown in FIG. 3, communication between the second port 11 and the third port 12 is established.

At the condition shown in FIG. 2, when the first control pressure is higher than the second control pressure, the valve spool 13 is depressed toward the right. Then, the second port 11 is communicating with the third port 12 via the cut-out 20. Thus, the pressure in the second port 11 becomes a pressure corresponding to the pressure at the third port 12, namely the second control pressure becomes a pressure corresponding to the first control pressure. Then, the pump discharge pressure and the supply pressure of the supply passage 24 become equal to each other.

At the condition shown in FIG. 2, when the second control pressure is higher than the first control pressure, the valve spool 13 is depressed toward the left. Then, communication between the second port 11 and the third port 12 is blocked. Also, the push rod 18 pushes the check valve 6 in a direction for blocking communication between the inlet port 4 and the outlet port 5. Therefore, the open area between the inlet port 4 and the outlet port 5 is reduced to lower the supply pressure to less than the pump discharge pressure.

Thus, when the first control pressure to be supplied to the first pressure chamber 14 of the pressure reduction valve 21 is higher than the second control pressure to be supplied to the second pressure chamber 15, the pump discharge pressure is lowered. Then, the pressure (second control pressure) of the third port 12 becomes equal to the pressure of the first port 10 (first control pressure). Also, the pressure at the inlet port 4 (pump discharge pressure) and the pressure of the outlet port 5 (supply pressure) become equal to each other. For instance, when the pump discharge pressure is 120 $kg/cm^2$ and the first control pressure is 100 $kg/cm^2$, the second control pressure becomes 100 $kg/cm^2$ and the supply pressure becomes 120 $kg/cm^2$.

Similarly, when the second control pressure is higher than the first control pressure, the second port 11 and the third port 12 do not communicate. Therefore, the pump discharge pressure is not supplied to the third port 12. Also, by the check valve 6, the open area between the inlet port 4 and the outlet port 5 is reduced. Thus, the supply pressure becomes lower than the pump discharge pressure to an extent corresponding to the pressure difference between the second control pressure and the first control pressure. For instance, when the pump discharge pressure is 120 $kg/cm^2$, the first control pressure is 10 $kg/cm^2$ and the second control pressure becomes 100 $kg/cm^2$, the supply pressure becomes 30 $kg/cm^2$.

As set forth above, in the hydraulic circuit supplying the discharged pressurized fluid to a plurality of actuators, the pressurized fluid can be distributed to respective actuators similarly to the prior art, by connecting the supply passage 24 to the inlet port of the direction control valve, introducing the load pressure of an actuator to the load pressure introduction passage 25 and establishing communication of the load pressure detection passage 26 to respective pressure compensation valves.

Figure 4:
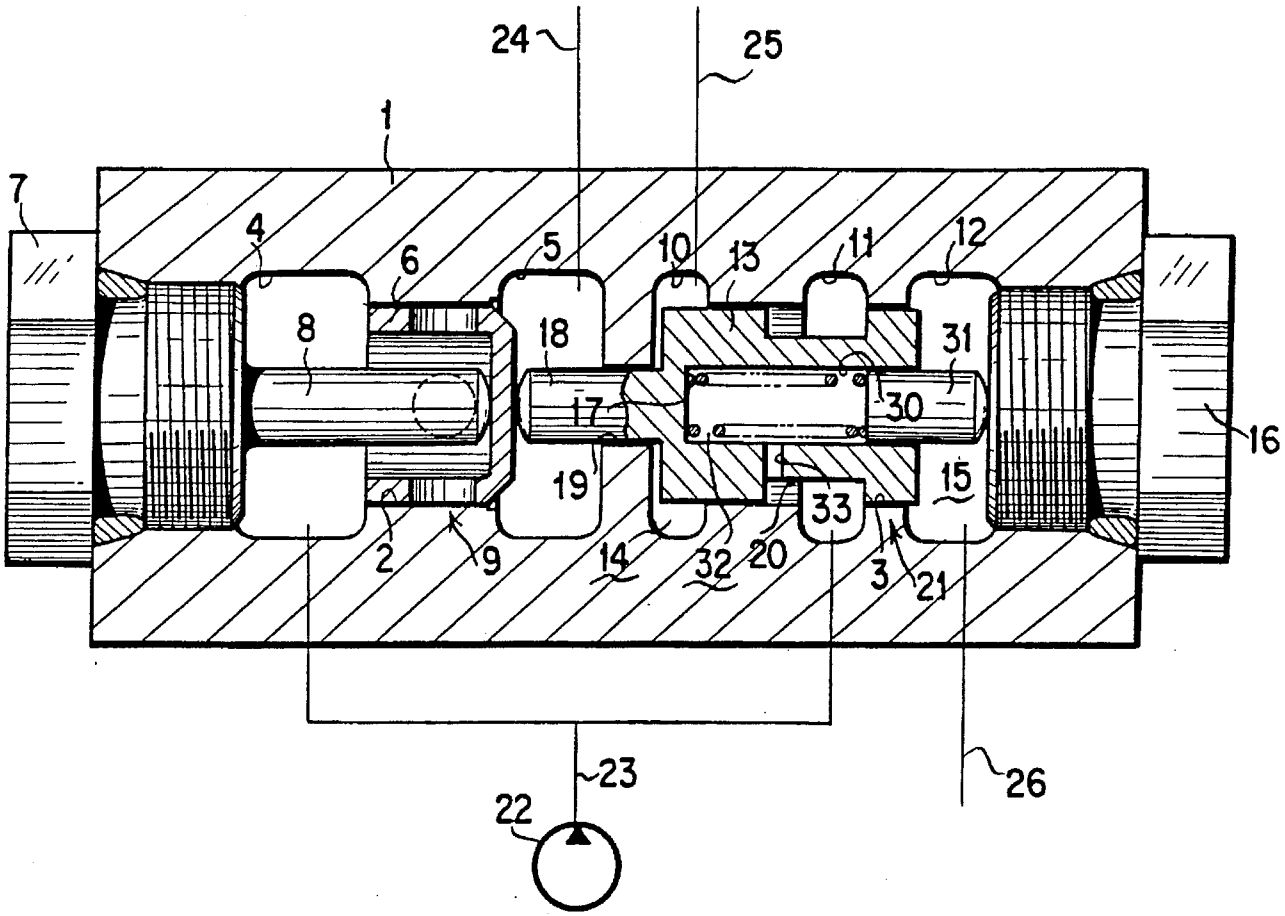
FIG. 4 is a sectional view of a second embodiment of a pressure compensation valve.

FIG. 4 shows the second embodiment, in which a piston 31 is inserted in a blind bore 30 of the valve spool 13. The piston 31 is biased toward the plug 16 by means of a weak spring 17. A spring chamber 32 of the spring communicates with the second port 11 via a conduit 33.

With such construction, the pressure receiving area of the valve spool 13 receiving pressure in the second pressure chamber 15 can be reduced to be equal to the pressure receiving area of the spool 13 that receives the pressure in the first pressure chamber 14. Also, by varying the diameter of the piston 31, a difference of the pressure receiving areas of the first pressure chamber 14 and the second pressure chamber 15 can be varied so that the precision of flow rate distributing function can be arbitrarily adjusted.

Namely, when the push rod 18 performs the pressure compensating function while contacting the check valve 6, all of the pressure receiving areas of the check valve 6 of the check valve portion 9 and the valve spool 13 of the pressure reduction valve portion 21 can be made equal to one another to make the supply flow rate of the actuators to be equal to the target value.

However, as a countermeasure for hunting, it becomes necessary to make the supply flow rate for the actuators greater than the target value. In such a case, by making the diameter of the piston 31 smaller, the pressure receiving areas of the check valve portion and the pressure reduction valve portion can be varied. As a result, the supply flow rate for the actuators can be varied relative to the target value so that hunting of the actuator driving the inertia body can be prevented.

Figure 5:
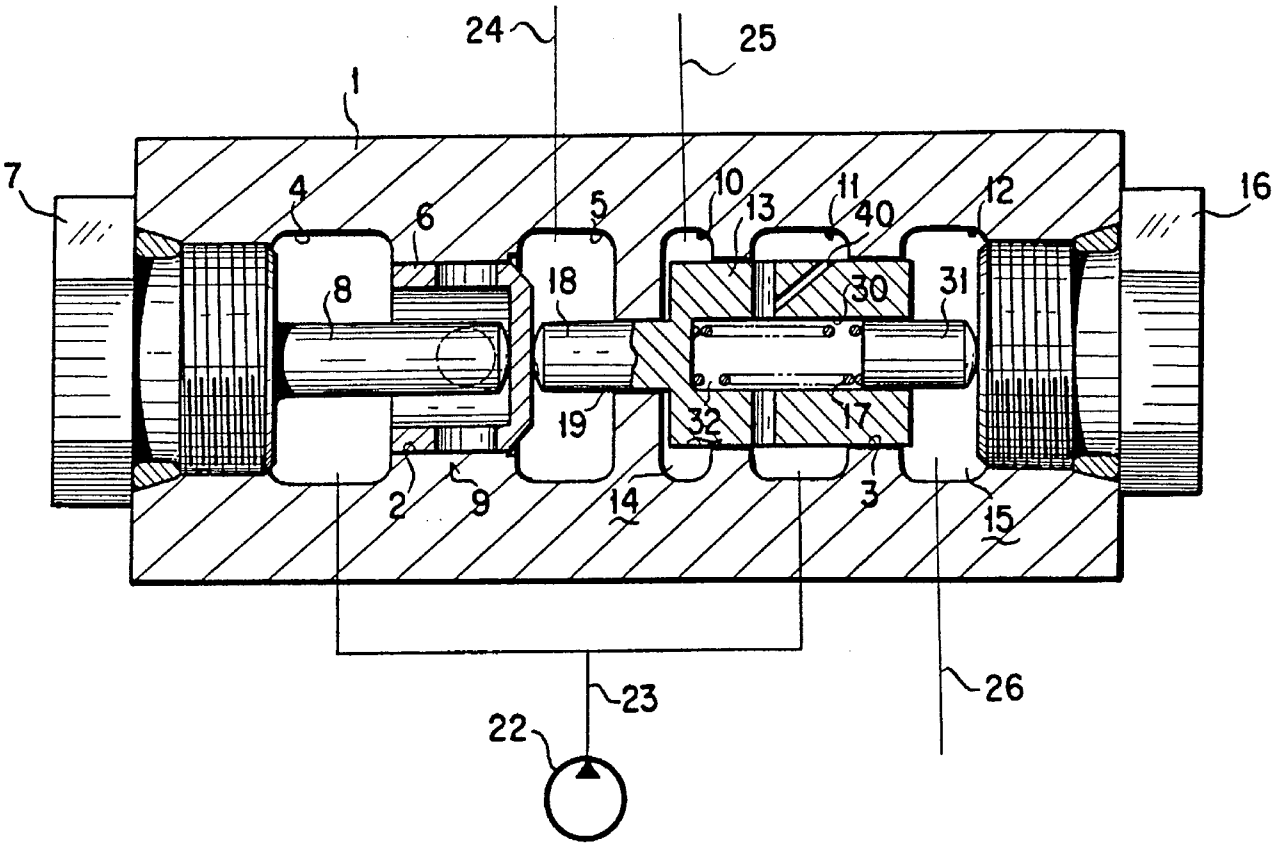
FIG. 5 is a sectional view of a third embodiment of a pressure compensation valve.

FIG. 5 shows the third embodiment, in which an orifice 40 is formed to supply the pump discharge pressure of the hydraulic pump 22 to the third port 12.

With the constructions, when the second port 11 and the third port 12 communicate, the pump discharge pressure is supplied to the third port 12 at a reduced pressure. Therefore, for example, the pump discharge pressure can be maintained even when a relief valve 41 is provided in the load pressure detection passage 26 as shown in FIG. 6.

Figure 6:
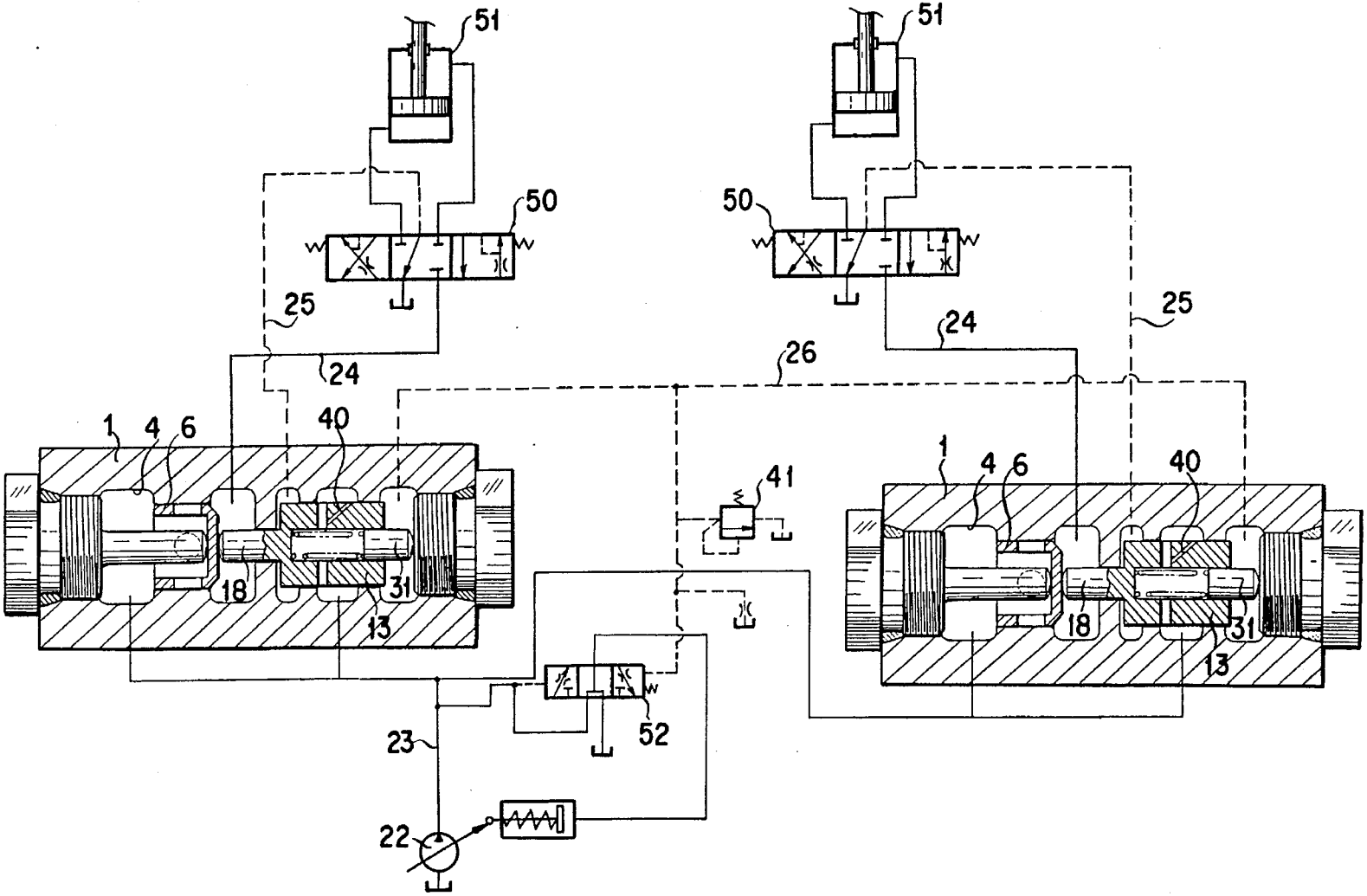
FIG. 6 is a diagram of a hydraulic circuit employing the third embodiment.

In FIG. 6, reference numerals 50 denote direction control valves, 51 actuators, and 52 a pump capacity control valve.

When the pressure of the first pressure chamber 14 is higher than the pressure of the second pressure chamber 15, the valve spool 13 is moved away from the check valve 6. Then, the pressures of the first pressure chamber 14 and the pressure of the second pressure chamber 15 become equal to each other. When the pressure of the first pressure chamber 14 is lower than the pressure of the second pressure chamber 15, the check valve 6 is pushed in the blocking direction by the valve spool 13 so that the pressure at the outlet port 5 becomes lower than the pressure at the inlet port 4 to an extent corresponding to the pressure difference between the second pressure chamber 15 and the first pressure chamber 14.

As set forth above, by providing this pressure compensation valve in the hydraulic circuit supplying the discharged pressurized fluid of the hydraulic pump to a plurality of actuators, the discharged pressurized fluid of a single hydraulic pump can be distributed to a plurality of actuators without employing the shuttle valve.

Figure 7:
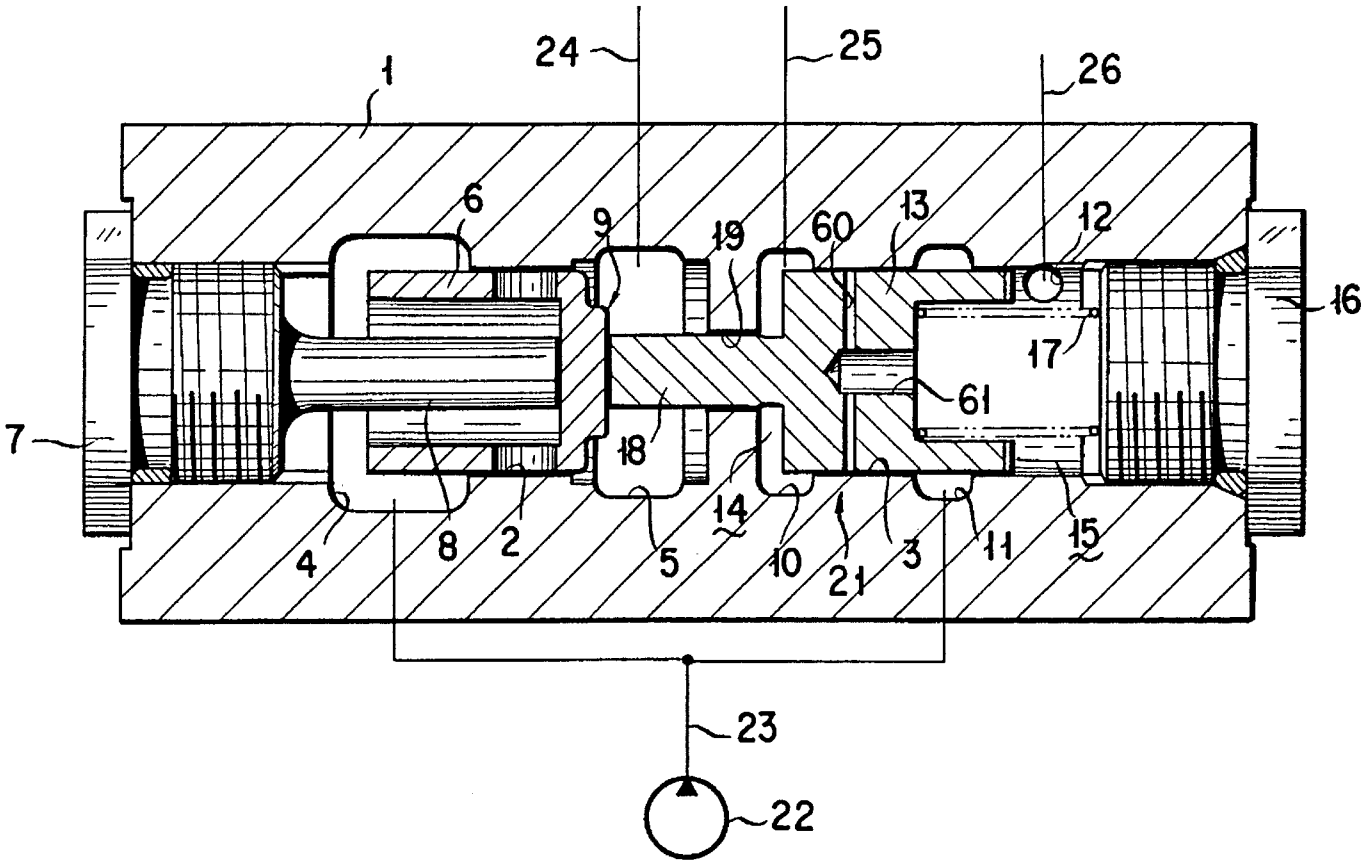
FIG. 7 is a sectional view of a fourth embodiment of a pressure compensation valve.

FIG. 7 shows the fourth embodiment of the pressure compensation valve according to the present invention, which is intended to suppress the influence of the viscosity and fluid temperature of the working fluid on the pressure reduction characteristic and also suppress the influence of machining error on the pressure reduction performance, for improving distribution performance. Therefore, in the shown embodiment, in addition to the basic construction as illustrated in FIG. 1, radially extending conduits 60 and an axially extending blind hole 61 are formed in the valve spool 13. By these passageways the second port 11 and the third port 12 are placed in communication.

Figure 8:
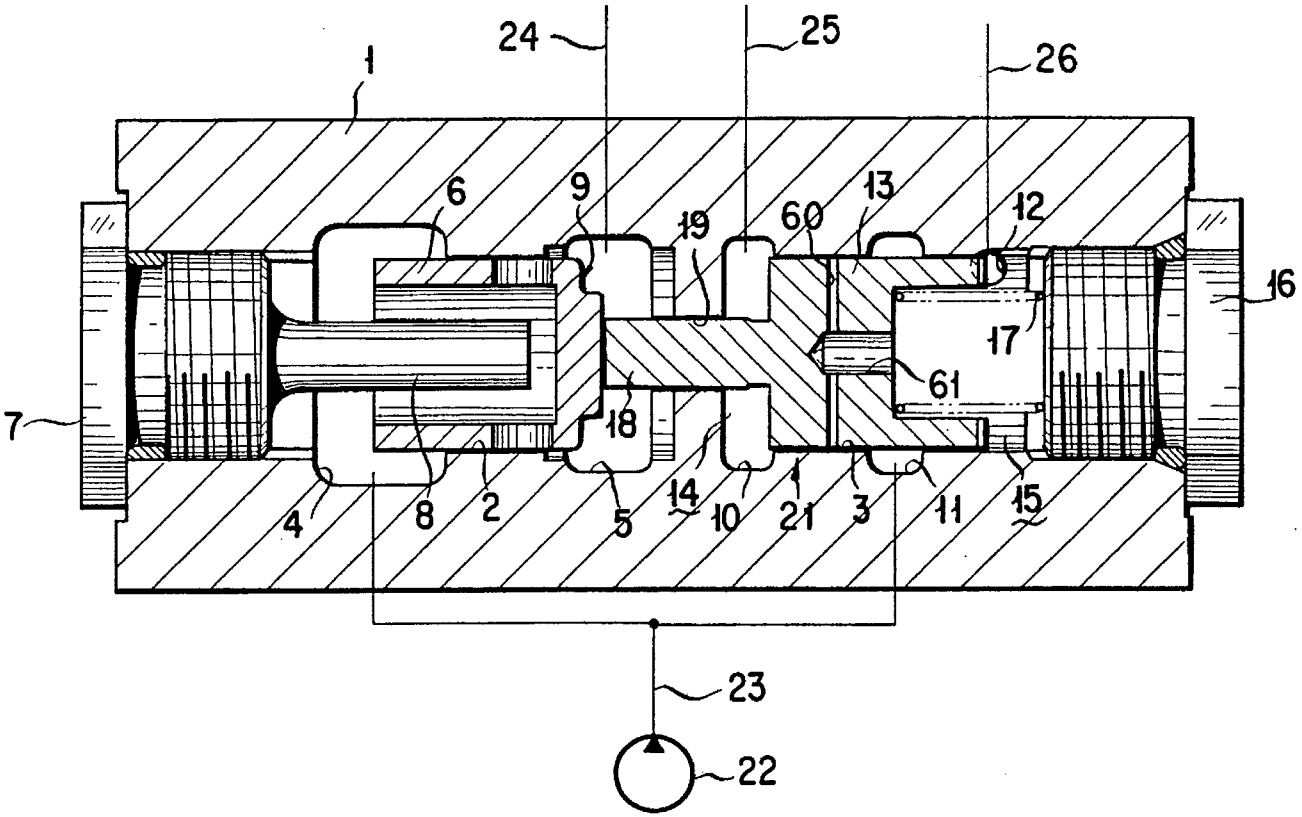
FIG. 8 is an explanatory illustration showing an operation of the fourth embodiment.
Figure 9:
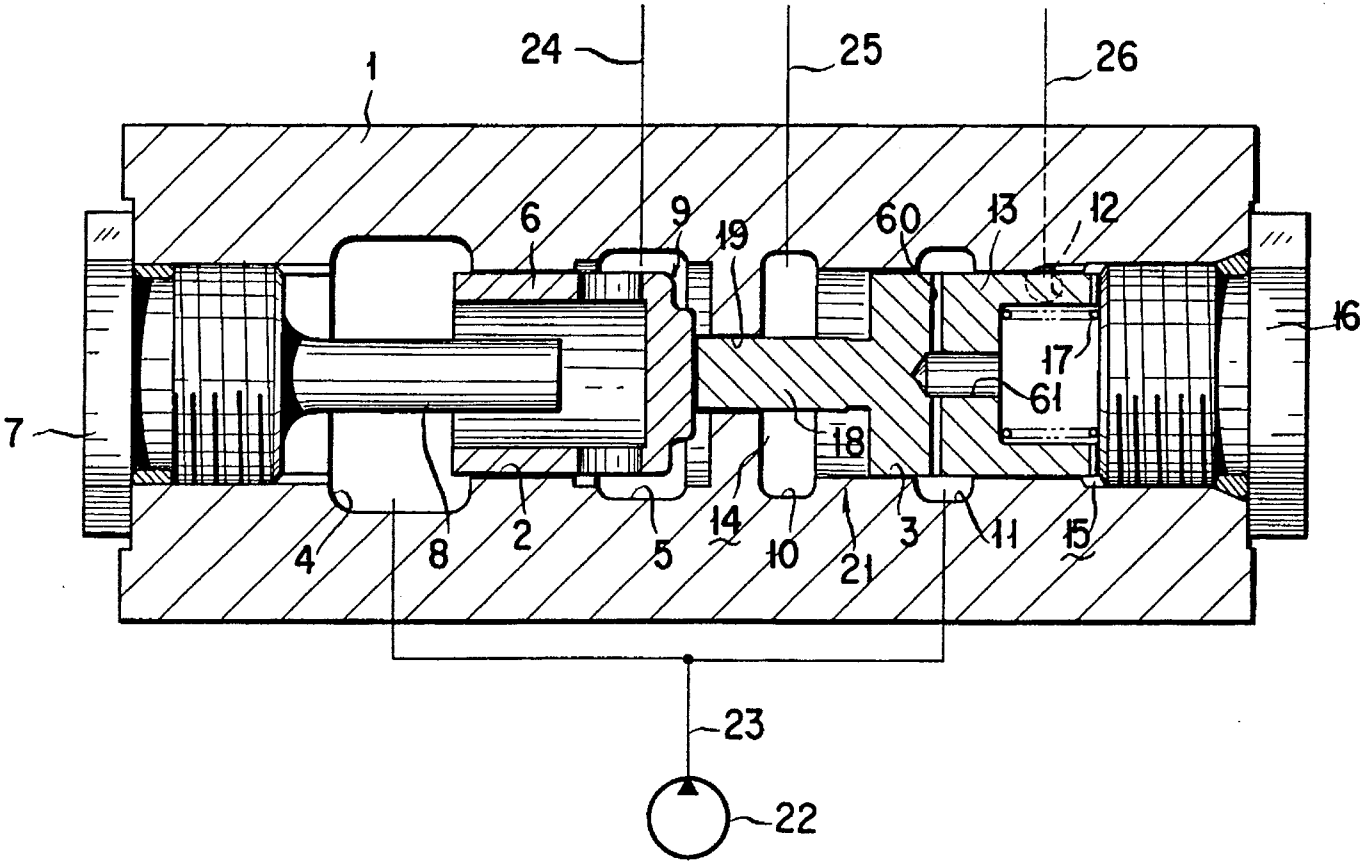
FIG. 9 is an explanatory illustration showing an operation of the fourth embodiment.

Even in this construction, similarly to the embodiment of FIG. 1, when the pump discharge pressure of the hydraulic pump 22 is low pressure and the pressures of the load pressure introduction passage 25 and the load pressure detection passage 26 are zero, the check valve 6 is placed at the position shown in FIG. 1 to slide the check valve 6 by the pressure of the supply passage 24 to block the outlet port 5 and the inlet port 4 to prevent reverse flow. When the pump discharge pressure of the hydraulic pump 22 has risen, the check valve 6 is urged as shown in FIG. 8 to establish communication between the inlet port 4 and the outlet port 5 to supply the pressurized fluid to the supply passage 24 from the outlet port 5. When the check valve 6 is shifted to the stroke end as shown in FIG. 9, communication between the second port 11 and the third port 12 is established via the conduits 60 and the blind hole 61. Under the condition shown in FIG. 8, when the first control pressure is higher than the second control pressure, the valve spool 13 depressed toward right. Then, the second port 11 communicates with the third port 12 via the conduits 60 and the blind hole 61. Thus, the pressure in the second port 11 becomes a pressure corresponding to the pressure at the third port 13, namely the second control pressure becomes a pressure corresponding to the first control pressure. Then, the pump discharge pressure and the supply pressure of the supply passage 24 become equal to each other. Under the condition shown in FIG. 8, when the second control pressure is higher than the first control pressure, the valve spool 13 is depressed toward the left. Then, communication between the second port 11 and the third port 12 is blocked. Also, the push rod 18 pushes the check valve 6 in a direction for blocking communication between the inlet port 4 and the outlet port 5. Therefore, the open area between the inlet port 4 and the outlet port 5 is reduced to lower the supply pressure below the pump discharge pressure. Thus, when the first control pressure to be supplied to the first pressure chamber 14 of the pressure reduction valve 21 is higher than the second control pressure to be supplied to the second pressure chamber 15, the pump discharge pressure is lowered. Then, the pressure (second control pressure) of the third port 12 becomes equal to the pressure (first control pressure) of the first port 10. Also, the pressure at the inlet port 4 (pump discharge pressure) and the pressure of the outlet port 5 (supply pressure) become equal to each other. For instance, when the pump discharge pressure is 120 $kg/cm^2$ and the first control pressure is 100 $kg/cm^2$, the second control pressure becomes 100 $kg/cm^2$ and the supply pressure becomes 120 $kg/cm^2$.

Similarly, when the second control pressure is higher than the first control pressure, the second port 11 and the third port 12 communicate. Therefore, the pump discharge pressure is not supplied to the third port 12. Also, by the check valve 6, the open areas of the inlet port 4 and the outlet port 5 are reduced. Thus, the supply pressure becomes lower than the pump discharge pressure to an extent corresponding to the pressure difference between the second control pressure and the first control pressure. For instance, when the pump discharge pressure is 120 $kg/cm^2$, the first control pressure is 10 $kg/cm^2$ and the second control pressure becomes 100 $kg/cm^2$, the supply pressure becomes 30 $kg/cm^2$.

Figure 10:
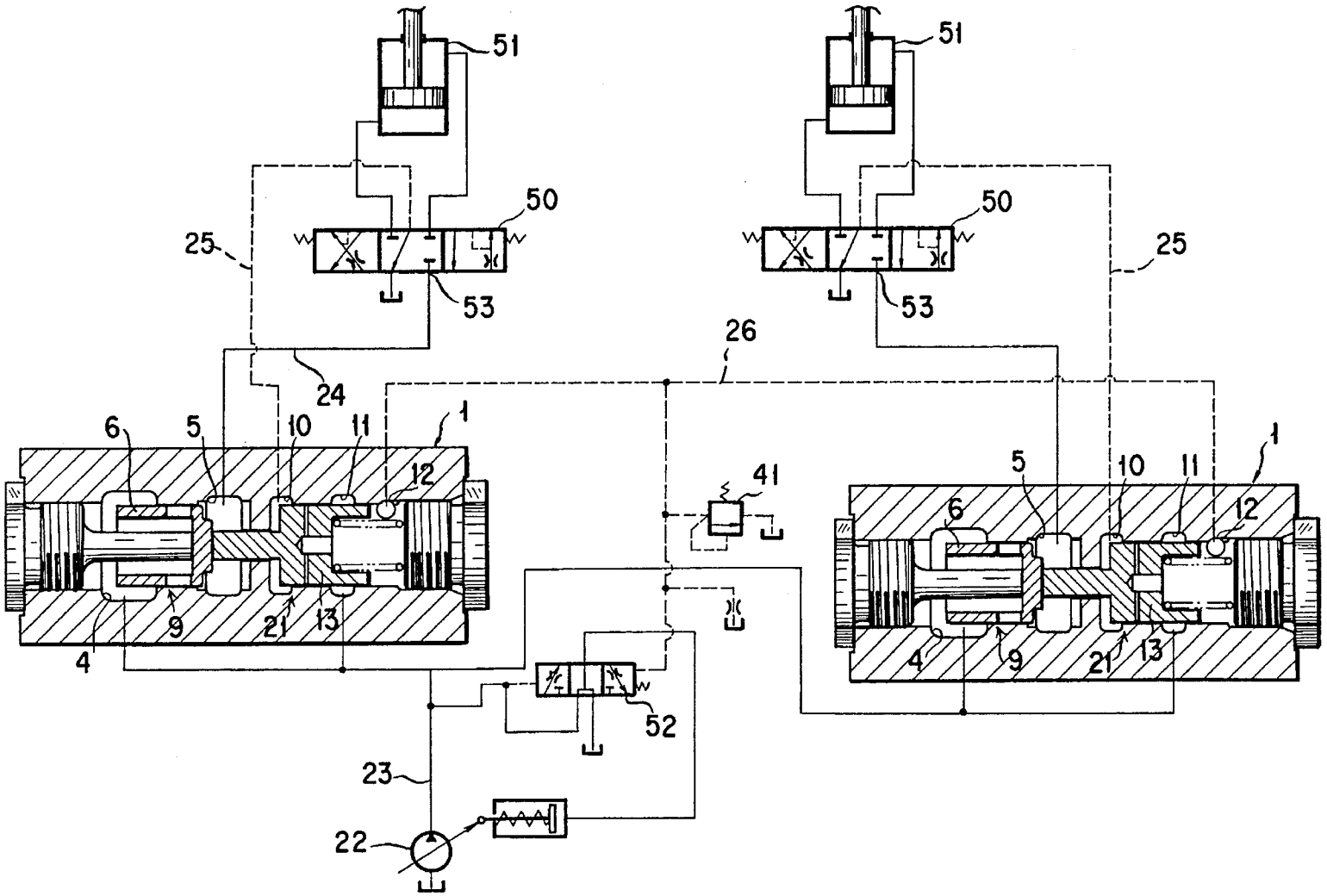
FIG. 10 a diagram of a hydraulic circuit employing the fourth embodiment.

As set forth above, in the hydraulic circuit supplying the discharged pressurized fluid of the single hydraulic pump, the pressurized fluid can be distributed to respective actuators 51 similarly to the prior art by connecting the supply passage 24 to the inlet port 53 of the direction control valve, introducing the load pressure of the own actuator 51 into the load pressure introduction passage 25 and supplying the load pressure detection passage 26 to respective pressure compensation valves, as shown in FIG. 10. When the pressure of the first pressure chamber 14 is higher than the pressure of the second pressure chamber 15, the valve spool 13 is moved away from the check valve 6. Then, the pressures of the first pressure chamber 14 and the pressure of the second pressure chamber 15 become equal to each other. When the pressure of the first pressure chamber 14 is lower than the pressure of the second pressure chamber 15, the check valve 6 is pushed in the blocking direction by the valve spool 13 so that the pressure at the outlet port 5 becomes lower than the pressure to an inlet port 4 to an extent corresponding to the pressure difference between the second pressure chamber 15 and the first pressure chamber 14.

Also, since the second port 11 and the third port 12 communicates through the conduits 60 and the blind hole 61, the pressure reducing performance will not be influenced by the viscosity of the fluid, namely the fluid temperature. Also, since no machining error may be caused, the pressure reducing performance, and thus the distribution performance can be improved.

It should be noted a compact valve block in which the operation valve and the pressure compensation valve shown in FIGS. 6 and 10 are integrated has been disclosed in the commonly owned International Patent Application entitled "Operation Valve with Pressure Compensation Valve" filed on Apr. 9, 1993 and on which U.S. Ser. No. 08/318,631 is based. Also, it is possible to form the operation valve by constructing respective components of the operation valve as sub-units separately from the valve body 10 and assembling them. Such a construction has been disclosed in a commonly owned U.S. Pat. No. 5,372,060. The disclosures of the above-identified International application, and U.S. patent application and patent are herein incorporated by reference.

Furthermore, the construction and operation of the pump capacity control valve 52 for controlling the discharge amount of the pump 22 has been disclosed in detail in commonly owned International Patent Application entitled "Pressurized Fluid Supply System", filed on Apr. 8, 1993, and on which U.S. Ser. No. 08/302,912 is based. The above-identified International patent applications and U.S. application are also herein incorporated by reference.

Although the invention has been illustrated and described with respect to preferred embodiments thereof, it should be understood by those skilled in the art that the foregoing and various other changes, omissions and additions may be made therein and thereto, without departing from the spirit and scope of the present invention should not be understood as limited to the specific embodiments set out above but as including all possible changes and modifications thereof which can be made within the scope of the appended claims.

We claim:

1. A pressure compensation valve comprising:

a valve body defining therein an inlet port and an outlet port, first, second and third ports, a first pressure chamber communicating with said first port, and a second pressure chamber communicating with said third port;

a check valve portion provided in said valve body and including a check valve for establishing and blocking communication between said inlet port and said outlet port; and a pressure reduction valve provided in said valve body, said pressure reduction valve including a spool establishing communication between said second port and said third port when a predetermined pressure is generated in said first pressure chamber and blocking communication between said second port and said third port when a predetermined pressure is generated in said second pressure chamber, and said pressure reduction valve also including a spring biasing said spool to a position at which said spool will block communication between said second port and said third port while contacting said check valve.

2. A pressure compensation valve comprising:

a valve body defining therein an inlet port and an outlet port, first, second and third ports, a first pressure chamber communicating with said first port, and a second pressure chamber communicating with said third port;

a check valve portion provided in said valve body and including a check valve for establishing and blocking communicating between said inlet port and said outlet port; and a pressure reduction valve provided in said valve body, said pressure reduction valve including a spool defining therein a blind hole communicating with said second pressure chamber and a conduit extending radially therethrough from said blind hole, said spool establishing communication between said second port and said third port via said radially extending conduit and said blind hole when a predetermined pressure is generated in said first pressure chamber and blocking communication between said second port and said third port when a predetermined pressure is generated in said second pressure chamber, and said pressure reduction valve also including a spring biasing said spool to a position at which said spool will block communication between said second port and said third port while contacting said check valve.

3. A pressurized fluid supply system comprising: a plurality of pressure compensation valves connected to a pump discharge passage of a hydraulic pump; direction control valves connected by hydraulic lines to outlet sides of said pressure compensation valves, respectively; and a plurality of actuators to which discharged pressurized fluid of said hydraulic pump is supplied; and wherein each of said pressure compensation valves includes a valve body defining therein an inlet port and an outlet port, first, second and third ports, a first pressure chamber communicating with said first port, and a second pressure chamber communicating with said third port, a check valve portion for establishing and blocking communication between the pump discharge passage and an inlet port of a respective one of said direction control valves, and a pressure reducing portion for reducing the pump discharge pressure, said check valve portion being provided in said valve body and including a check valve for establishing and blocking communication between said inlet port and said outlet port, and said pressure reducing portion comprising a pressure reduction valve provided in said valve body, said pressure reduction valve including a spool establishing communication between said second port and said third port when a predetermined pressure is generated in said first pressure chamber and blocking communication between said second port and said third port when a predetermined pressure is generated in said second pressure chamber, and said pressure reduction valve also including a spring biasing said spool to a position at which said spool will block communication between said second port and said third port while contacting said check valve.

4. In combination with a pressurized fluid supply system, a pressure compensation valve comprising:

a valve body defining therein an inlet port and an outlet port, a first port communicating with a hydraulic load of said system so as to receive fluid therefrom under load pressure, a second port connected to a supply passage communicating with a hydraulic pressure source of said system so as to receive fluid from said source under output hydraulic pressure, a third port that receives fluid from the system under pressure corresponding to a maximum load pressure, a first pressure chamber communicating with said first port, and a second pressure chamber communicating with said third port;

a check valve portion provided in said valve body and including a check valve for establishing and blocking communication between said inlet port and said outlet port; and a pressure reducing valve portion provided in said valve body and connected to the hydraulic load of said system, said pressure reducing valve portion including a spool biased to a position at which communication is established between said second port and said third port when a predetermined pressure is generated in said first pressure chamber communicating with said first port to which the fluid from said hydraulic load under load pressure is introduced, and biased to a position at which communication between said second port and said third port is blocked when a predetermined pressure is generated in said second pressure chamber, and said pressure reducing valve portion including a spring exerting a force on said spool that biases said spool toward a position at which communication between said second port and said third port is blocked.

5. A pressure compensation valve in a pressurized fluid supply system as set forth in claim 4, and further comprising a blind bore formed in said spool, piston means disposed within said blind bore for biasing said spool with said spring toward said position at which communication between said second port and said third port will be blocked, and a passage extending through said spool and placing said second pressure chamber in communication with said blind bore when said spool is at a given position.

6. A pressure compensation valve in a pressurized fluid supply system as set forth in claim 5, wherein said passage extends radially through said spool.

7. A pressure compensation valve in a pressurized fluid supply system as set forth in claim 5, which further comprises an orifice formed in said spool for establishing communication between said passage and said second port.

8. A pressure compensation valve in a pressurized fluid supply system as set forth in claim 4, wherein said second and third ports are open at the inner periphery of a pressure reducing valve receptacle bore extending in said valve body, and an annular groove is formed on the outer periphery of said spool for establishing and blocking communication between said second and third ports when said annular groove is displaced to a given position during a stroke of said spool.

9. A pressure compensation valve as set forth in claim 4, wherein said second and third ports are open at the inner periphery of a pressure reducing valve receptacle bore extending in said valve body, a blind hole constantly communicating with said second pressure chamber is formed in said spool, and a passage communicating with said blind hole extends radially through said spool at a position at which the passage will communicate with said second port at a given position of the spool to establish communication between said second and third ports.

* * * * *